US011174541B2

(12) United States Patent
Fernández Rivera et al.

(10) Patent No.: US 11,174,541 B2
(45) Date of Patent: Nov. 16, 2021

(54) METHOD FOR LAMINATING ALUMINUM FOR FINE-GRAIN APPLICATIONS

(71) Applicant: ACR II ALUMINIUM GROUP COOPERATIEF U.A., Amstelveen (NL)

(72) Inventors: Catalina Fernández Rivera, Vizcaya (ES); David Bravo Espinosa, Vizcaya (ES)

(73) Assignee: ACR II ALUMINIUM GROUP COOPERATIEF U.A., Amstelveen (NL)

( * ) Notice: Subject to any disclaimer, the term of this patent is extended or adjusted under 35 U.S.C. 154(b) by 198 days.

(21) Appl. No.: 16/323,096

(22) PCT Filed: Jul. 28, 2017

(86) PCT No.: PCT/IB2017/054602
§ 371 (c)(1),
(2) Date: Feb. 4, 2019

(87) PCT Pub. No.: WO2018/073658
PCT Pub. Date: Apr. 26, 2018

(65) Prior Publication Data

US 2019/0185978 A1 Jun. 20, 2019

(30) Foreign Application Priority Data

Aug. 5, 2016 (ES) ..... ES201631077

(51) Int. Cl.
*C22F 1/04* (2006.01)
*C22F 1/047* (2006.01)
(Continued)

(52) U.S. Cl.
CPC ..... *C22F 1/04* (2013.01); *B21B 3/00* (2013.01); *C22C 21/00* (2013.01); *C22F 1/047* (2013.01); *B21B 2003/001* (2013.01)

(58) Field of Classification Search
CPC ..... C22F 1/04
(Continued)

(56) References Cited

U.S. PATENT DOCUMENTS

2010/0229822 A1* 9/2010 Kurita ..... F02F 1/20 123/195 R

FOREIGN PATENT DOCUMENTS

CN 101086049 12/2007
CN 104532075 4/2015
(Continued)

OTHER PUBLICATIONS

The Aluminum Association, "Rolling Aluminum: From the Mine through the Mill" (Year: 2008).*
(Continued)

*Primary Examiner* — Coris Fung
*Assistant Examiner* — Danielle Carda
(74) *Attorney, Agent, or Firm* — Carmody Torrance Sandak & Hennessey LLP

(57) ABSTRACT

The present invention describes an aluminum rolling method comprising a stage a) of hot rolling at an initial temperature ranging from 450 to 500° C. up to a final temperature ranging from 360 to 400° C., obtaining an aluminum sheet with a thickness between 8 and 12 mm; and a stage b) of cold rolling wherein rolling passes at a temperature ranging from 75 to 120° C. are intercalated with an intermediate sub-stage of heat treatment at a temperature ranging from 340 to 390° C., until obtaining an aluminum sheet with a final thickness between 0.3 and 1 mm. Another object of the invention is the rolled aluminum obtained from the method explained in the
(Continued)

present application and its use in manufacturing containers for the cosmetic and perfume industry.

4 Claims, 1 Drawing Sheet

(51) Int. Cl.
*B21B 3/00* (2006.01)
*C22C 21/00* (2006.01)

(58) Field of Classification Search
USPC ..... 148/692
See application file for complete search history.

(56) References Cited

FOREIGN PATENT DOCUMENTS

| | | |
|---|---|---|
| JP | H11256294 | 9/1999 |
| JP | 2000096172 | 4/2000 |
| JP | 3180812 | 6/2001 |
| JP | 2001294963 | 10/2001 |
| JP | 2005325420 | 11/2005 |
| JP | 2011202240 | 10/2011 |
| JP | 5762387 B2 * | 8/2015 |

OTHER PUBLICATIONS

Karhausen et al. "Aluminum Hot and Cold Rolling" (Year: 2014).*
Translation JP-5762387-B2 (Year: 2015).*
Gardner, et al., "Recrystallization during hot deformation of aluminium alloys," Metal Science, vol. 13, No. 3-4, pp. 216-222, Mar. 18, 1979.
Liu Yang et al. "Light Nonferrous Metals and Their Alloy Plate, Strip and Foil Production", Metallurgical Industry Press, p. 208 9.3.1.1, Apr. 2013 (partial translation).
"2005 China Packaging Yearbook", China Packaging Federation, Atomic Energy Press, p. 232, 2, Jul. 2006 (partial translation).

* cited by examiner

METHOD FOR LAMINATING ALUMINUM FOR FINE-GRAIN APPLICATIONS

TECHNICAL FIELD

The present patent application describes an aluminum rolling method able to obtain a product especially suitable for use in the manufacture of containers for the cosmetic and perfume industries.

BACKGROUND

Rolled aluminum products which are intended to be applied in the market of cosmetic or perfume containers require certain particularly demanding conditions concerning the shape and surface quality thereof in comparison with other products. The metal must have an excellent response to surface chemical treatments which are applied in the manufacturing process of these containers, such as chemical polishing, electropolishing, anodizing, lacquering, etc. Additionally, a suitable combination of mechanical properties of the metal is also necessary to provide an optimal response to the deep drawing treatment of the metal to form the final piece.

When rolled aluminum obtained by the method currently carried out by Aludium Transformaciones de Productos, S.L.U. is used for the manufacture of containers, a process referred to in this patent application as "standard procedure", and this manufacture comprises the application of surface treatments, a striated, non-uniform appearance is produced, and, therefore the manufactured container does not comply with the demanding requirements of the cosmetic and perfume industry.

Unlike other rolling methods known to date, the aluminum rolling method described in this patent application allows rolled aluminum to be obtained with formability properties and surface quality that meet the requirements for use in the manufacture of containers for the cosmetic and pharmaceutical industries.

DESCRIPTION

In a first aspect, the present patent application relates to an aluminum rolling method comprising a stage a) of hot rolling and a stage b) of cold rolling,
characterized in that:

in the stage a) of hot rolling, the temperature decreases from an initial temperature ranging from 450 to 500° C., preferably an initial temperature of 500° C., to a final temperature ranging from 360 to 400° C., preferably a final temperature of 380° C., obtaining an aluminum sheet with a thickness ranging from 8 to 12 mm, preferably a thickness of 10 mm; and in the stage b) of cold rolling, rolling passes at a temperature ranging from 75 to 120° C., preferably a temperature of 75° C., are intercalated with an intermediate sub-stage of heat treatment at a temperature ranging from 340 to 390° C., preferably at a temperature of 350° C., and for a time ranging from 3 to 5 hours, preferably for 4 hours, until obtaining an aluminum sheet with a final thickness ranging from 0.3 to 1.0 mm.

In the present patent application, it must be understood that "aluminum" comprises both pure metal and alloys of this metal. In particular, aluminum alloys comprising magnesium as the main alloying compound. Therefore, the present invention refers to a method of rolling pure aluminum or any combination of aluminum.

In a preferred embodiment of the present invention, in the hot rolling stage, the temperature decreases from a temperature of approximately 500° C. to a final temperature of 380° C., obtaining an aluminum sheet with a thickness of 10 mm; and in the cold rolling stage, rolling passes at a temperature of approximately 75° C. are intercalated with the intermediate sub-stage of heat treatment at a temperature of approximately 350° C. for 4 hours.

In the intermediate sub-stage of heat treatment, also known as "total intermediate annealing sub-stage", the aluminum sheet is subjected to a temperature ranging from 340 to 390° C., preferably for a period of 4 hours. To reach a temperature in this interval, the aluminum sheet, preferably in the form of a coil, may be heated in an oven for a period that may reach up to 16 hours. In another preferred embodiment, in the intermediate sub-stage of heat treatment, the aluminum sheet is subjected to a temperature of approximately 350° C. for 4 hours.

Thus, the rolling method of the present invention comprises two rolling stages in different conditions, such that in the hot rolling stage, the thickness of the aluminum is reduced from the thickness of the casting plate, generally 600 mm, to a thickness ranging from 8 to 12 mm, preferably to a thickness of 10 mm; and in the cold rolling stage, the thickness is reduced from a range of 8 to 12 mm, to the final required thickness, between 0.3 and 1 mm. The combination of both stages, done in series, allows to obtain an improved surface quality, especially suitable for using the rolled aluminum obtained in the manufacture of containers for the cosmetic and perfume industry.

In the aluminum rolling method of the present invention, each one of the stages may comprise several rolling passes through a system of rollers or a similar device known by a person skilled in the art to carry out aluminum rolling. Specifically, the hot rolling stage may comprise between 15 and 20 passes of aluminum rolling through the system of rollers or a similar device to obtain an aluminum sheet with a thickness ranging from 8 to 12 mm, and preferably, a thickness of 10 mm.

In preferred embodiments, after stage b) of cold rolling, the aluminum rolling method described in this patent application comprises a heat treatment at a temperature ranging from 220 to 260° C. of the aluminum sheet, preferably for a period of 4 to 6 hours. This stage of the method of the invention, also known in this document as "final partial annealing stage", allows the formability of the metal to be improved in the methods, such as shaping or deep drawing, in which the aluminum sheet obtained will be used. In a more preferred embodiment, the heat treatment after the cold rolling stage is carried out at a temperature of 260° C. for 5 hours.

The standard procedure also comprised a hot rolling stage, but the conditions were different from those of the method of the present invention. In these conditions, a reduction of the thickness was achieved in the last hot rolling pass at a range from 35% to 55%, and a grain structure without total recrystallization after the hot rolling stage was also achieved, with an average coarse grain size of 100-140 μm, measured by the grain intercept method (ASTM E-112-88) (see FIG. 1*a*).

Advantageously, the rolling method of the present invention achieves a reduction in the thickness in the last hot rolling pass from 45% to 75%, preferably 65%, and after the hot rolling stage, a grain structure can be achieved that is totally recrystallized with a fine grain size between 50 and 90 μm, and preferably, 60 micrometers for average grain size, measured by the grain intercept method (ASTM E-112-

88) and a high thickness, between 8 and 12 mm, and preferably a thickness of 10 mm (see FIG. 1*b*).

The objective of stage b) of cold rolling is to obtain the finest and most deformed grain structure possible, since this will positively influence the surface quality of the final product. To achieve this grain structure, it is necessary to intercalate a total intermediate annealing sub-stage between the different passes comprised in the cold rolling, wherein this total intermediate annealing sub-stage is carried out at a temperature ranging from 340 to 390° C., preferably at a temperature of 350° C. Once the established temperature has been reached, for which up to 16 hours may be necessary, the aluminum sheet is maintained at this temperature interval for a period ranging from 3 to 5 hours, preferably for 4 hours. This sub-stage of total intermediate annealing is necessary in the method of the present invention, since it is not possible to obtain a final fine grain (between 50 and 90 μm, preferably between 80 and 90 μm) by rolling directly from the hot grinding (between 8 and 12 mm, preferably, 10 mm) to a final thickness between 0.3 and 1 mm. Moreover, there is an increased risk of the start of secondary recrystallization during the final partial annealing, which would negatively affect the surface appearance of the anodized pieces. By means of the standard cold rolling procedure, a final material was obtained with a very heterogeneous grain structure with coarse sizes of 120-160 μm and a deformation of 60-80% (see FIG. 2*a*).

In this cold rolling stage of the method, it is important to establish the thickness to which the intermediate sub-stage of heat treatment will be carried out, also known in this patent application as "total intermediate annealing stage", in order to obtain a final grain that has a balance between the size and deformation. Thus, the lower the thickness of the sheet when the total intermediate annealing is applied, the finer the final grain obtained. On the other hand, the greater the thickness of the sheet when the total intermediate annealing is applied, the greater the deformation obtained.

Preferably, the intermediate sub-stage of heat treatment is carried out with a sheet thickness between 3 and 5 mm, preferably with a thickness of 4 mm. This way, the aluminum rolling method of the present invention allows a homogenous grain structure to be obtained with a fine size of 60-90 μm, preferably a fine size between 80-90 μm, and a deformation between 70-90%, preferably between 80-90%, depending on the final thickness (see FIG. 2*b*).

Additionally, the present invention also relates to the rolled aluminum obtained by the rolling method described in the patent application. Preferably, rolled aluminum with a final thickness between 0.3 and 1.0 mm.

Rolled aluminum obtained by the rolling method described in this patent application may be in the form of cut multi-strip coils with a width range from 24 mm to 1,250 mm. Additionally, this product may be H22, H24, H26, in accordance with the international standard UNE-EN 485-2.

In preferred embodiments of the present invention, the rolled aluminum obtained by the method described in this patent application may have different finishes, such as gloss, greater roughness, low anisotropy, a matte finish with a 3 xxx alloy code, meaning aluminum alloys characterized for having manganese as a main alloy, and a highly pure band application (with lower Fe and Si content), based on the requirements of the container manufacturer.

This patent application also relates to the use of the rolled aluminum obtained from the method described in this patent application for manufacturing containers for the cosmetic and perfume industry.

EXAMPLES

Example 1: Aluminum Rolling Method

Figure 1A:
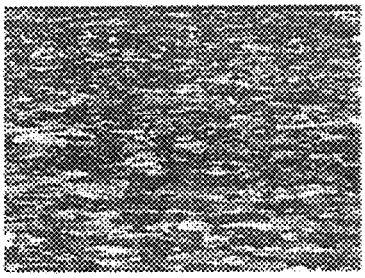
Fig. 1a Prior Art
FIG. 1: Grain structure obtained after the hot rolling stage according to the standard procedure (FIG. 1*a*) and according to the aluminum rolling method described in this patent application (FIG. 1*b*).
Figure 1B:
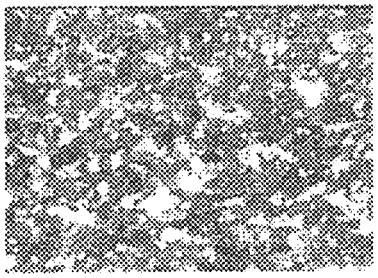
Figure 2A:
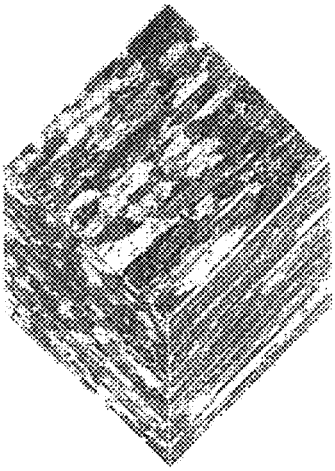
Fig. 2a Prior Art
FIG. 2: 3D grain structure obtained by the standard procedure (FIG. 2*a*) and by means of the aluminum rolling method described in this patent application (FIG. 2*b*).
Figure 2B:
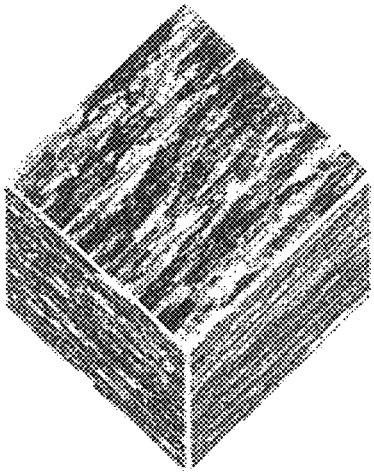

First, a system of rollers is heated to an initial temperature of 500° C. Once this temperature is reached, an aluminum sheet with an initial thickness of 600 mm is passed through the roller system. This rolling process is repeated 15 to 20 times, progressively decreasing the temperature of the system until reaching a final temperature of 380° C., obtaining an aluminum sheet with a thickness of 10 mm.

Once the established thickness is reached, the aluminum sheet is transferred in the form of a coil to another system of rollers which work at a lower temperature, approximately 75° C., and the aluminum sheet obtained in the previous stage is passed through this cold rolling system of rollers. This rolling process is done successively until obtaining a thickness of 4 mm.

Then, the aluminum sheet obtained in the form of a coil is subjected to an intermediate sub-stage of heat treatment at a temperature of 350° C. In order to carry out the intermediate heat treatment (total intermediate annealing) the aluminum coil is heated in an oven until reaching a temperature of 350° C., and is then maintained for 4 hours at this temperature. After this time period, it is removed from the oven and left to cool until reaching a temperature of approximately 70° C.

Then the aluminum sheet is passed through the roller system at a temperature of 75° C. until obtaining a sheet with the final desired thickness: from 1 mm to 0.3 mm.

Lastly, the aluminum sheet obtained by the method previously described is subjected to heat treatment at a temperature of 260° C. for a period of 5 hours. To carry out this treatment, the aluminum sheet coils are introduced in an oven and heated until reaching the established temperature. This temperature interval is then maintained for a period of 5 hours.

The invention claimed is:

1. An aluminum rolling method comprising a stage a) of hot rolling and a stage b) of cold rolling an aluminum sheet:

in the stage a) of hot rolling, the temperature decreases from an initial temperature ranging from 450 to 500° C. to a final temperature ranging from 360 to 400° C., obtaining a hot rolled aluminum sheet with a thickness ranging from 8 to 12 mm; and in the stage b) of cold rolling, rolling passes at a temperature ranging from 75 to 120° C. are intercalated with an intermediate sub-stage of heat treatment at a temperature ranging from 340 to 390° C., until obtaining a cold rolled aluminum sheet with a final thickness ranging from 0.3 to 1.0 mm;

wherein the intermediate sub-stage of heat treatment is carried out for a period ranging from 3 to 5 hours, the aluminum rolling method further comprising, after the stage b) of cold rolling:

a heat treatment at a temperature ranging from 220 to 260° C. of the cold rolled aluminum sheet for a period of 4 to 6 hours;

wherein an aluminum in the aluminum sheet is selected from pure aluminum and an aluminum alloy comprising magnesium as the main alloying compound; and wherein a reduction in the thickness from 45% to 75% is achieved in the final hot rolling pass, and after the hot rolling stage, a grain structure is totally recrystallized with a grain size between 50 and 90 μm measured by the grain intercept method ASTM E-112-88, and wherein each one of the stages comprises several rolling passes through a system of rollers.

2. The aluminum rolling method of claim 1, wherein in the hot rolling stage a), the temperature decreases from a temperature of 500° C. to a final temperature of 380° C., obtaining an aluminum sheet with a thickness of 10 mm; and in the cold rolling stage b), rolling passes at a temperature of 75° C. are intercalated with the intermediate sub-stage of heat treatment at a temperature of 350° C. for 4 hours.

3. The aluminium rolling method according to claim 1, wherein the aluminum sheet is used for manufacturing a container for the cosmetic and perfume industry.

4. The aluminum rolling method of claim 1, wherein the intermediate sub-stage of heat treatment is carried out with an aluminum sheet having a thickness between 3 and 5 mm.

* * * * *